US008753138B2

(12) United States Patent
Foster, Sr. et al.

(10) Patent No.: US 8,753,138 B2
(45) Date of Patent: Jun. 17, 2014

(54) MEMORY MODULE CONNECTOR WITH AUXILIARY POWER

(71) Applicant: International Business Machines Corporation, Armonk, NY (US)

(72) Inventors: Jimmy G. Foster, Sr., Morrisville, NC (US); Tony C. Sass, Fuquay Varina, NC (US); Paul A. Wormsbecher, Apex, NC (US)

(73) Assignee: International Business Machines Corporation, Armonk, NY (US)

( * ) Notice: Subject to any disclaimer, the term of this patent is extended or adjusted under 35 U.S.C. 154(b) by 59 days.

(21) Appl. No.: 13/647,757

(22) Filed: Oct. 9, 2012

(65) Prior Publication Data

US 2014/0099815 A1 Apr. 10, 2014

(51) Int. Cl.
*H01R 13/62* (2006.01)

(52) U.S. Cl.
USPC ..... 439/326; 439/160

(58) Field of Classification Search
USPC ..... 439/326, 160
See application file for complete search history.

(56) References Cited

U.S. PATENT DOCUMENTS

| | | | | |
|---|---|---|---|---|
| 3,673,669 | A | 7/1972 | Edstrom et al. | |
| 4,008,942 | A | 2/1977 | Grossi | |
| 4,818,240 | A | 4/1989 | Karner | |
| 5,383,792 | A | 1/1995 | Korsunsky et al. | |
| 5,691,882 | A | 11/1997 | Ma | |
| 5,745,426 | A | 4/1998 | Sekiyama | |
| 6,097,883 | A | 8/2000 | Dell et al. | |
| 6,135,781 | A | 10/2000 | Pope et al. | |
| 6,162,069 | A | 12/2000 | Choy | |
| 6,176,725 | B1 | 1/2001 | Kobayashi et al. | |
| 6,246,578 | B1 | 6/2001 | Wei et al. | |
| 6,270,369 | B1 | 8/2001 | Kato et al. | |
| 6,347,039 | B1 | 2/2002 | Lee | |
| 6,407,933 | B1 | 6/2002 | Bolognia et al. | |
| 6,414,869 | B1 | 7/2002 | Kao et al. | |
| 6,863,572 | B1 | 3/2005 | Yi et al. | |
| 7,832,645 | B2 | 11/2010 | Chen et al. | |
| 8,023,304 | B2 | 9/2011 | Choi | |
| 2008/0261433 | A1* | 10/2008 | Pipho | 439/326 |
| 2009/0083487 | A1 | 3/2009 | Wardensky et al. | |
| 2010/0128447 | A1* | 5/2010 | MacDougall et al. | 361/737 |
| 2010/0241799 | A1 | 9/2010 | Schuette | |
| 2011/0246014 | A1* | 10/2011 | Sauper | 701/22 |
| 2011/0299316 | A1 | 12/2011 | Choi | |
| 2012/0184120 | A1* | 7/2012 | Basta et al. | 439/213 |

FOREIGN PATENT DOCUMENTS

| | | | |
|---|---|---|---|
| JP | 11066246 | A | 3/2011 |
| KR | 10-2005-0034403 | | 4/2005 |

* cited by examiner

*Primary Examiner* — Gary Paumen
(74) *Attorney, Agent, or Firm* — Katherine S. Brown; Jeffrey L. Streets

(57) ABSTRACT

An apparatus includes a socket that receives a memory module that includes a card having card edge voltage pads along the lower card edge, auxiliary voltage pads along at least one of the vertical card edges, and one or more persistent, solid-state memory chips on one or both card faces. A latch pivotally coupled to the socket is movable between a latched position and an unlatched position. The latch includes electrical latch contacts positioned for being engaged with the auxiliary voltage pads when that latch is in the latched position and being disengaged from the auxiliary voltage pads when the latch is in the unlatched position. The electrical latch contacts may provide a different voltage to the auxiliary voltage pads than the socket provides to the card edge voltage pads along the lower card edge.

20 Claims, 6 Drawing Sheets

MEMORY MODULE CONNECTOR WITH AUXILIARY POWER

BACKGROUND OF THE INVENTION

1. Field of the Invention

The present invention relates to memory module connectors, and more particularly to a memory module connector that provides auxiliary power to a memory module.

2. Background of the Related Art

Computer systems range from smaller, general purpose computers suitable for household and office use, to larger and more specialized computer systems. A personal computer (PC) is an example of a general-purpose computer that has a selection of hardware and peripherals suitable for an individual user. A desktop computer is a PC that is designed to be set up and used for an extended period of time at a fixed location having access to an electrical power outlet. A laptop computer has the same general capabilities of a desktop, along with features for enhanced mobility, such as lighter weight, an integrated display, and a battery pack for use at a variety of locations even where a building power outlet is unavailable. A server is another type of computer configured for serving the needs of multiple users simultaneously, which has particular utility in business environments. A larger system of interconnected servers may be consolidated in a single location for centralized system administration, and to provide access to multiple users over a network.

General purpose computers and servers both include a combination of what may be referred to as short-term memory and long-term memory. Long-term memory provides a large storage capacity of a non-volatile (i.e. persistent) type, which persists even when the system is in a powered-off state. The most common long-term memory devices include hard disk drives (HDD) with rotating magnetic disks and newer solid-state devices (SSD) that require no moving parts for storage. Short-term memory, referred to usually as "system memory," typically has much less storage capacity but also much faster access times than long-term memory. Short-term memory devices typically comprise memory modules with dynamic random access memory (DRAM) chips. DRAM chips are a transient (volatile) SSD, in that the DRAM chips have no moving parts but require constant power and a refresh rate. The relatively large capacity and persistent storage of long-term memory devices are suitable for storing software applications, data, and files indefinitely until ready for use by the computer system. When a computer system is in a powered-on state, selected software instructions and data may then be retrieved from long-term memory into short-term memory for faster, more efficient execution by a processor directly from short-term memory.

BRIEF SUMMARY OF THE INVENTION

In one embodiment, an apparatus comprises a memory module including a card having horizontal upper and lower card edges, a pair of vertical card edges, and a pair of opposing card faces, with card edge voltage pads along the lower card edge, auxiliary voltage pads along at least one of the vertical card edges, and one or more memory chips on one or both card faces. A socket is provided for receiving the memory module at the lower card edge and supporting the memory module in a fully seated position. The socket includes a plurality of electrical socket contacts for engagement with the card edge voltage pads along the lower card edge when the memory module is in the fully seated position. A latch is pivotally coupled to the socket and movable between a latched position and an unlatched position. The latch includes electrical latch contacts positioned for being engaged with the auxiliary voltage pads when the latch is in the latched position and being disengaged from the auxiliary voltage pads when the latch is in the unlatched position.

DETAILED DESCRIPTION OF THE INVENTION

A disclosed memory system includes a memory module that incorporates a persistent (i.e. non-volatile) solid-state memory structure as an alternative to a conventional DIMM. In one embodiment, the memory module has a form factor comparable to that of a standard dual in-line memory module (DIMM) and can be substituted for a conventional DIMM as system memory. The persistent storage structure may comprise non-volatile storage chips, such as NAND flash memory chips, that can be electrically erased and reprogrammed. As with a conventional DIMM, selected software instructions can be loaded from long-term memory into the disclosed memory module for execution by a processor when the system is in a powered on state. However, unlike the DRAM chips on a conventional DIMM, the persistent memory structure of the disclosed memory module retains the selected software instructions and data even without a steady supply of power to the memory module. This ability to retain software instructions and data in memory even in a powered-off state has some desirable attributes, such as providing faster system startup times and enhanced reliability in the event of a power loss.

The memory system further includes a memory module connector that supplies an auxiliary voltage to the memory module through a latch on the memory module connector. This higher voltage is used to supply the persistent storage structure. The auxiliary voltage provided through the latch is at a higher voltage than normally supplied to a conventional DIMM, which allows for more efficient voltage conversion to the voltage required by persistent memory structure (typically 3.3V). The persistent storage structure may take different forms and use the auxiliary voltage according to the embodiment. In one embodiment, the memory module may be a Flash DIMM with NAND flash chips. Rather than transforming the lower voltage conventionally supplied to a DIMM (e.g. 1.5V) up to 3.3V, greater efficiency is achieved by supplying the auxiliary voltage through the latch at a higher voltage (e.g. 12V) and transforming it down to 3.3V. In another embodiment, the memory module may comprise an NV-DIMM with a combination of both DRAM chips and non-volatile memory chips. When power is lost, a super capacitor may power the DRAM chips long enough to back up their memory state in the non-volatile memory chips. This backup power can be supplied by the auxiliary voltage routed through the latch. Supplying the auxiliary voltage through the latch on a memory module socket avoids the use of external cabling for that purpose, which is significant considering the high DIMM counts in servers.

Figure 1:
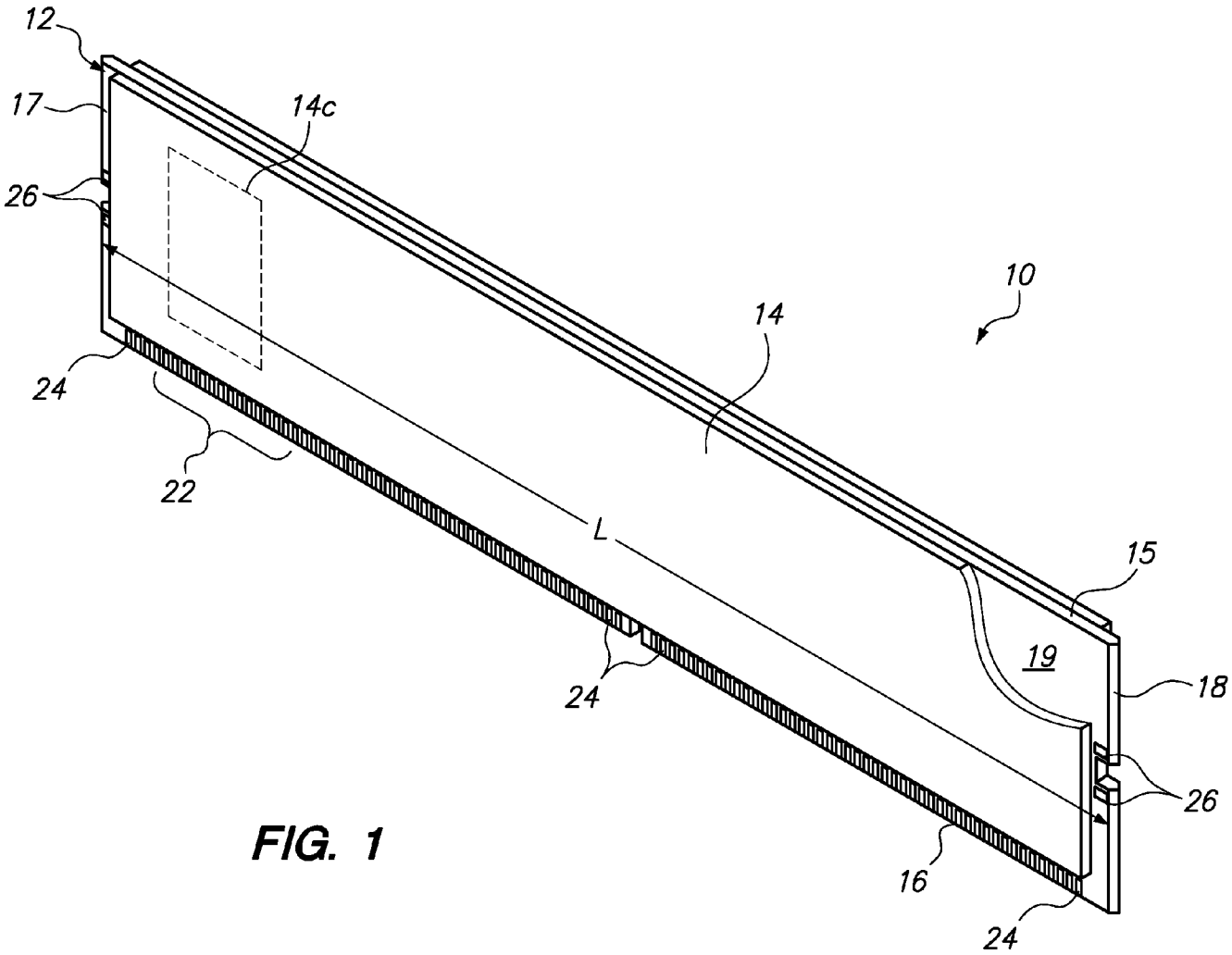
FIG. 1 is a perspective view of a first embodiment of a persistent, solid-state memory module including a semiconductor card and a persistent storage structure on opposing faces of the semiconductor card.

FIG. 1 is a perspective view of a first embodiment of a persistent, solid-state memory module 10 including a semiconductor card 12 and a persistent storage structure 14 on one or more of the opposing faces 19 of the semiconductor card 12. The semiconductor card 12 comprises a thin, substantially rectangular substrate, with opposing faces 19 bordered by opposing upper and lower card edges 15, 16 and opposing vertical card edges 17, 18 (only one of the two faces 19 is visible in the orientation of FIG. 1). The persistent storage structure 14 is provided on both faces 19 of the semiconductor card 12. The persistent storage structure 14 is a solid-state device (SSD) comprising persistent (non-volatile) storage. The persistent storage structure 14 is generically depicted as a unitary structure spanning the entire face 19 of semiconductor card 12, but optionally comprises any number of separate persistent memory devices or chips 14C secured along the card face 19 as indicated using dashed lines. The persistent memory structure 14 may be entirely non-volatile memory or a combination of volatile and non-volatile memory. For example, the memory module 10 may be a Flash DIMM wherein the persistent memory structure 14 consists of only NAND flash memory chips, or the memory module 10 may be an NV-DIMM wherein the persistent memory structure 14 includes a combination of NAND flash chips and DRAM chips.

The rectangular portion of the memory module 10 may include one or more standard DIMM dimensions, including at least a standard DIMM length "L" along the lower card edge 16, for interchangeable use with a DIMM socket as optionally modified according to the teachings of this disclosure. The lower card edge 16 has a plurality of electrical card edge contacts that may be at the same relative locations along the lower card edge 16 as the contacts on a conventional DIMM. These contacts include data contacts 22 along the lower card edge 16 for receiving digital input/output (I/O) signals to the persistent memory structure 14 and voltage pads 24 for supplying electrical power from a voltage source to the memory module 10. Auxiliary voltage pads 26 are also provided on the vertical card edges 17, 18 for providing an auxiliary voltage to power the persistent memory structure 14. A standard DIMM voltage such as 1.5V may be supplied to the card edge voltage pads 24, and a different voltage such as 12V may be supplied to the auxiliary pads 26 on the vertical edges 17, 18. The 12V auxiliary voltage supplies the higher voltage requirements of the persistent memory chips or other persistent storage structure 14.

Figure 2:
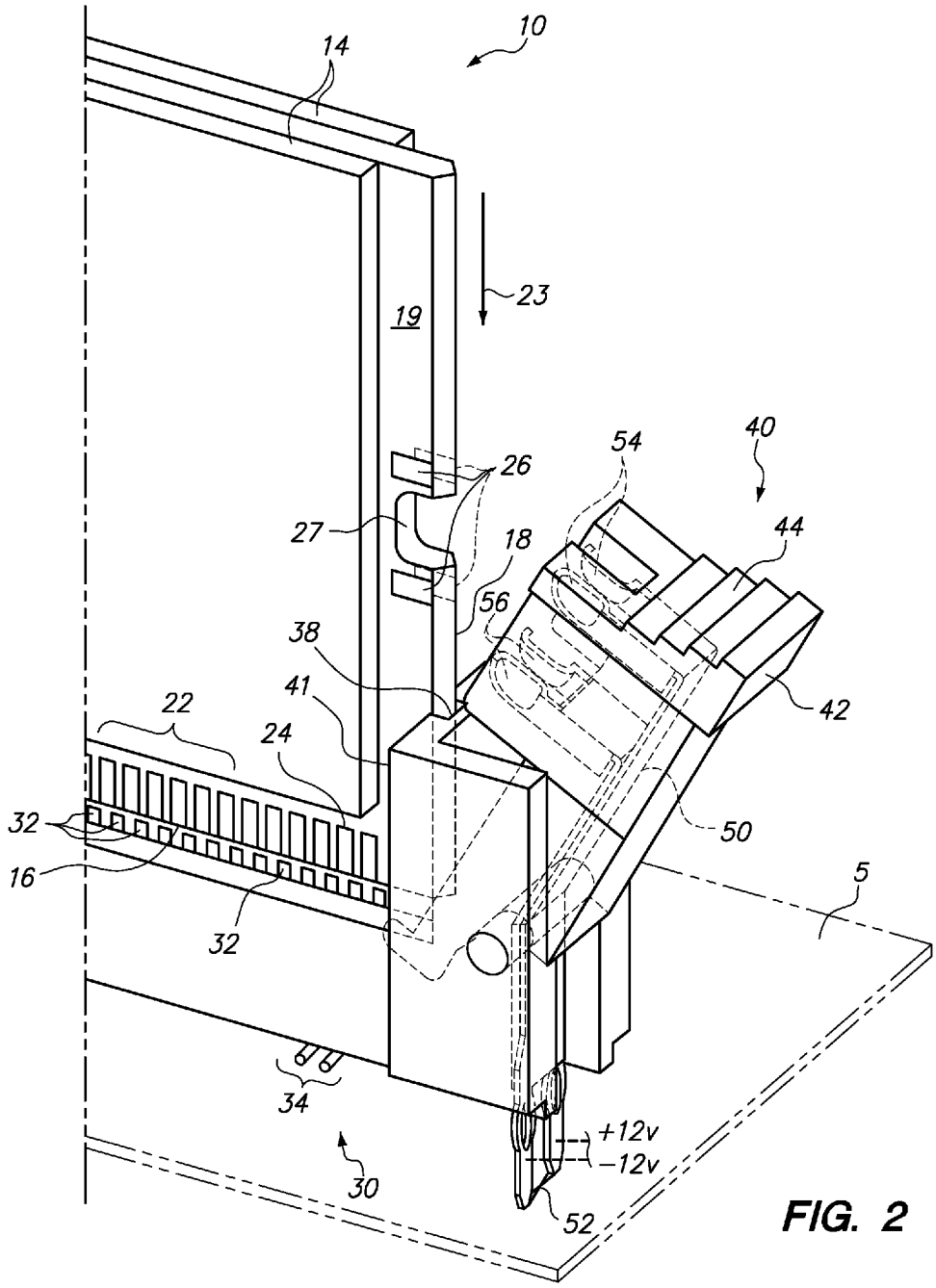
FIG. 2 is a partial, perspective view of the persistent, solid-state memory module of FIG. 1 partially inserted into a complimentary memory module socket.

FIG. 2 is a partial perspective view of the persistent memory module 10 of FIG. 1 partially inserted into a complimentary memory module socket 30. The socket 30 can be mounted to a printed circuit board (PCB) 5 using a conventional PCB lock used for DIMMs. The memory module socket 30 is an electrical connector specifically configured to receive the lower card edge 16 of the memory module 10 in a downward insertion direction 23. A plurality of socket contacts 32 are disposed within the socket 30, some of which are aligned for contacting corresponding card edge contacts 22 and others aligned for contacting voltage pads 24 on the memory module 10 when the memory module 10 is further moved to a fully seated position within the socket 30. A lower, standard voltage (e.g. 1.5V) is supplied to the specific socket contacts 32 aligned for contacting the voltage pads 24. This voltage may be supplied to the socket in a conventional manner; for purpose of illustration, a pair of voltage lines 34 leading to the socket supply this voltage.

The socket 30 includes a latch 40 for selectively securing the memory module 10 when fully seated in the socket 30. The latch 40 includes a latch tower 41 and a lever 42 that is pivotably coupled to the latch tower 41 and pivotable between an open (i.e. unlatched) position depicted in FIG. 2 and a closed (i.e. latched) position depicted in FIG. 4. A finger grip 44 on the lever 42 is shaped and textured for pivoting the lever 42 between the open and closed positions by hand. The latch tower 41 defines a portion of a slot 38 that closely engages and guides the memory module 10 at one vertical edge 18 (the "righthand edge"). A second latch (not shown) is generally provided at the other end of the socket 30 adjacent to the other vertical edge 17 (the "lefthand edge") (see FIG. 1) to secure the memory module 10 in the socket 30 from both ends of the memory module 10. The second latch is preferably identical to the latch 40, but could be made to secure the memory module without providing additional auxiliary power.

The latch 40 further includes an internally routed, electrically conductive beam 50 for supplying an auxiliary voltage (e.g. 12V) from the PCB 5 to the auxiliary voltage pads 26 on the memory module 10. The electrical beam 50 passes through the latch tower 41 and the lever 42, and flexes as the lever 42 is pivoted with respect to the latch tower 41. The beam 50 includes a lower end 52 for electrically connecting to a voltage source 61. The voltage source 61 may be 12V PCB voltage lines or a 12V power plane, which is supplied by the beam 50 through the lever 42 to power the persistent storage structure 14. For powering a memory module with volatile and non-volatile memory chips, such as an NV-DIMM, the voltage source 61 may comprise a super capacitor that may power the DRAM chips long enough to back up their memory state to non-volatile memory chips in the event of a power failure.

An upper end 54 of the beam 50 is for selectively electrically connecting to the memory module 10. In this embodiment, the auxiliary voltage pads 26 on the memory module 10 are provided on opposing faces of the memory module 10, with an upper pair of auxiliary pads 26 positioned directly above (vertically aligned with) a notch 27 on the memory module 10 and a lower pair of auxiliary pads 26 directly below the notch 27. The latch contacts 54, 56 are positioned along the lever 42 so that the upper latch contacts 54 contact the upper pair of auxiliary pads 26 and the lower latch contacts 56 contact the lower pair of auxiliary pads 26 when the memory module 10 is fully seated and the lever 42 is closed. In the open latch position of FIG. 2, the pairs of latch contacts 54, 56 are separated from the auxiliary voltage pads 26 on the memory module 10. The notch 27 on the vertical edge 18 of the memory module 10 engages with a feature on the latch when the lever 42 is closed. Thus, closing the latch simultaneously locks the memory module 10 within the socket 30 and completes the electrical connection for supplying the auxiliary (12V) voltage required for operating the persistent memory structures 14 on the memory module 10.

Figure 3:
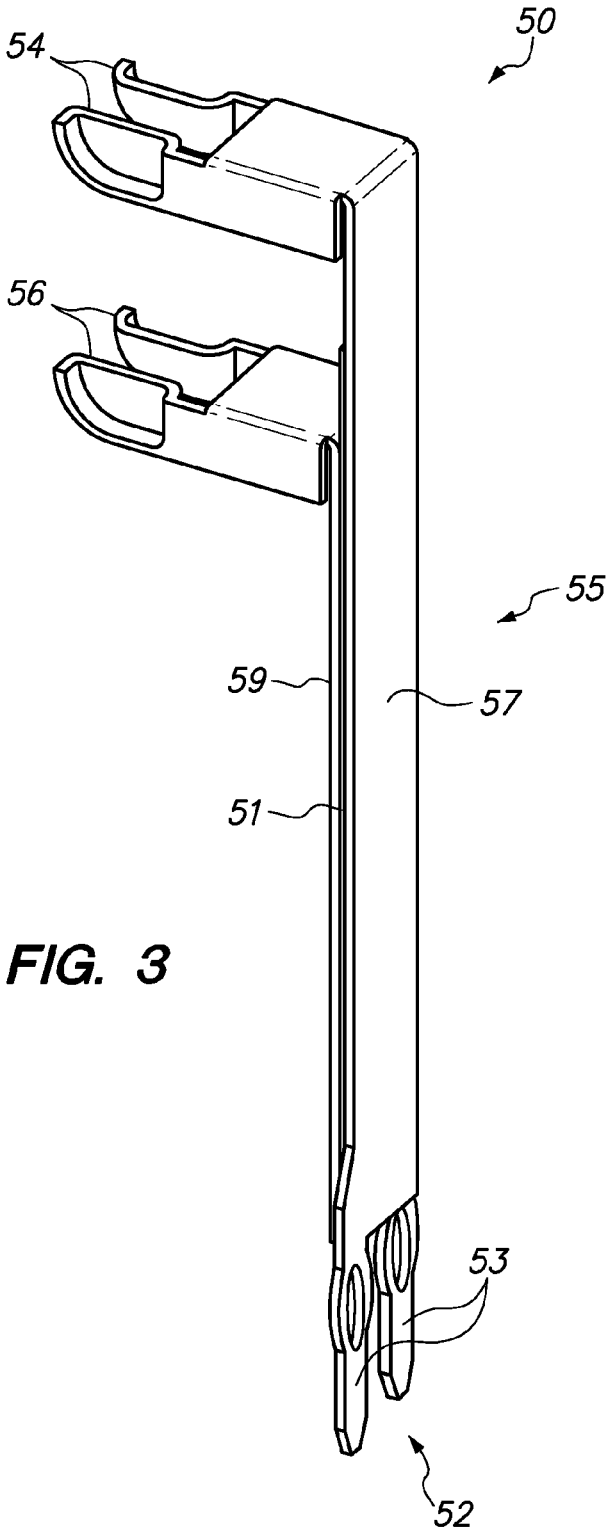
FIG. 3 is a perspective view further detailing the electrically conductive beam.

FIG. 3 is a perspective view further detailing the electrically conductive beam 50. The beam 50 includes an elongate central portion 55 comprising a flexible, electrically-conductive material that allows the central portion 55 of the beam 50 to be flexed without failure, preferably withstanding many cycles of latching and unlatching. The central portion 55 comprises two conductors 57, 59 (e.g. +/−12V) that are optionally laminated together with a dielectric spacer 51. The dielectric spacer 51 is an electrical insulator to prevent shorting between the conductors 57, 59. The electrically insulated conductors 57, 59 allow for multiple voltages (e.g. +/−12V) or a return path (e.g. 12V with a GND return). The lower end 52 of the beam 50 includes an electrical PCB connection, which in this embodiment is a compliant pin (press-fit) "eye-of-the-needle" type connectors 53 that frictionally secure the lower end 52 of the beam 50 to corresponding conductive through holes of the PCB 5. Other suitable PCB connections such as surface-mount or pin-through-hole may alternatively be used. Each eye-of-the-needle connector 53 is connected to a respective one of the two conductors 57, 59. The compliant pin element of these connectors 53 can also be used as a mechanical board lock prior to solder reflow in the case of an SMT DIMM socket. The upper and lower pairs of latch contacts 54, 56 comprise forked projections extending horizontally from the central portion 55 of the beam 50. The leading ends of the contacts are preferably flared to slidably receive the card edge, and the contacts are preferably free to flex outwardly as the card edge is slidably received there between.

Figure 4:
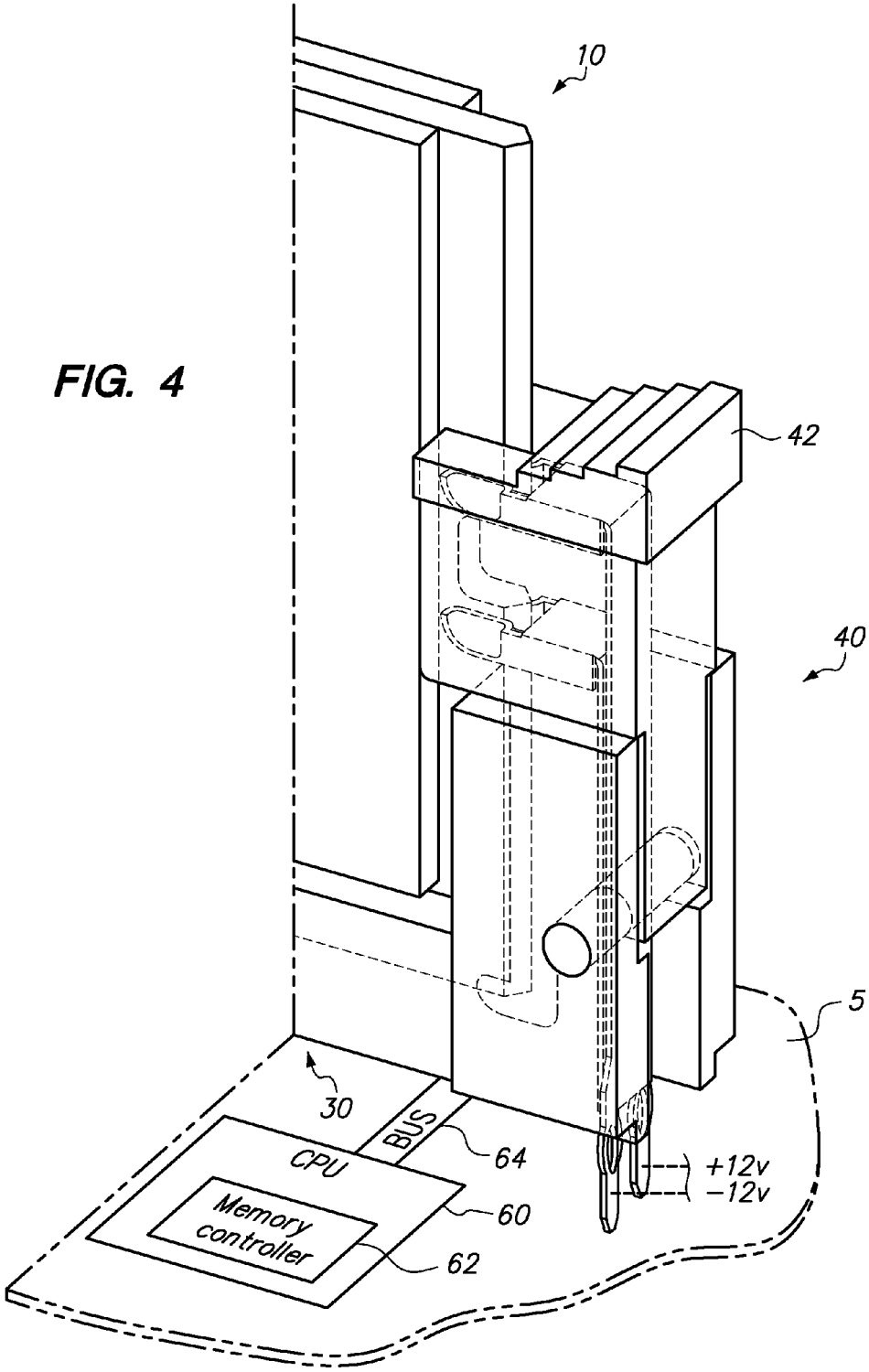
FIG. 4 is a partial, perspective view of the persistent, solid-state memory module in which the memory module is fully seated in the memory module socket and the lever is closed.

FIG. 4 is a partial, perspective view of the memory module 10 fully seated in the memory module socket 30 with the lever 42 closed. With the lever 42 closed, the latch 40 locks the memory module 10 within the socket 30 and simultaneously completed the circuit between the latch contacts and the auxiliary pads on the memory module. With this circuit completed, the system may supply the auxiliary 12V voltage to the memory module 10 as needed to power the persistent memory structures 14. A processor (CPU) 60 and memory controller 62 are schematically shown in communication with the socket 30 over a memory bus 64. The processor 60 and memory controller 62 are motherboard components known in the art apart from the specific teachings of this disclosure. The socket 30 provides an I/O and power interface between the memory controller 62 and the memory module 10. With the memory module 10 fully seated and latched in the socket 30, the memory controller 62 may now read and write to the persistent memory module 10.

Figure 5:
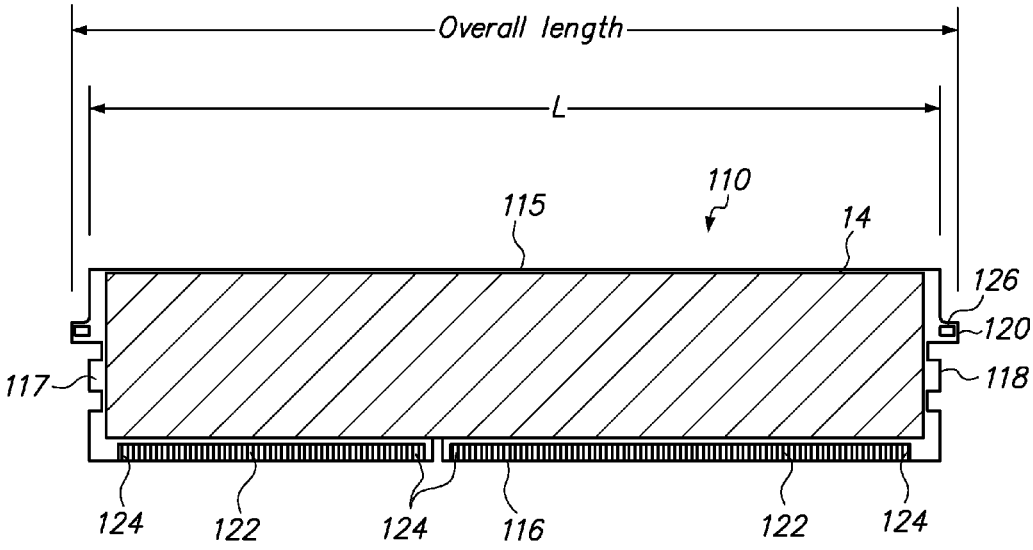
FIG. 5 is a side view of a second embodiment of a persistent, solid-state memory module.

FIG. 5 is a side view of a second embodiment of a memory card 110. Like the memory card 10 of FIG. 1, the memory card 110 in FIG. 5 has an upper card edge 115, lower card edge 116, and opposing (left and right) card edges 117, 118. The memory card 110 also has data contacts 122 along the lower card edge 116 for receiving digital input/output (I/O) signals to the persistent memory structure 14 and voltage pads 124. The lower card edge 116 may have standard DDR3 or DDR4 low profile DIMM pinout for receiving electrical power from a voltage source such as a power plane or super capacitor (in the case of an NV-DIMM). The length of the memory module 110 between opposing vertical edges 117, 118 is equal to the length "L" of a standard DIMM. A pair of tabs 120 is provided on the vertical edges 117, 118 of the memory card. A pair of auxiliary voltage pads 126 is formed on each card tab 120, such that the auxiliary voltage pads 126 at opposite ends of the memory module 110 are spaced apart at greater than the standard DIMM length L.

Figure 6:
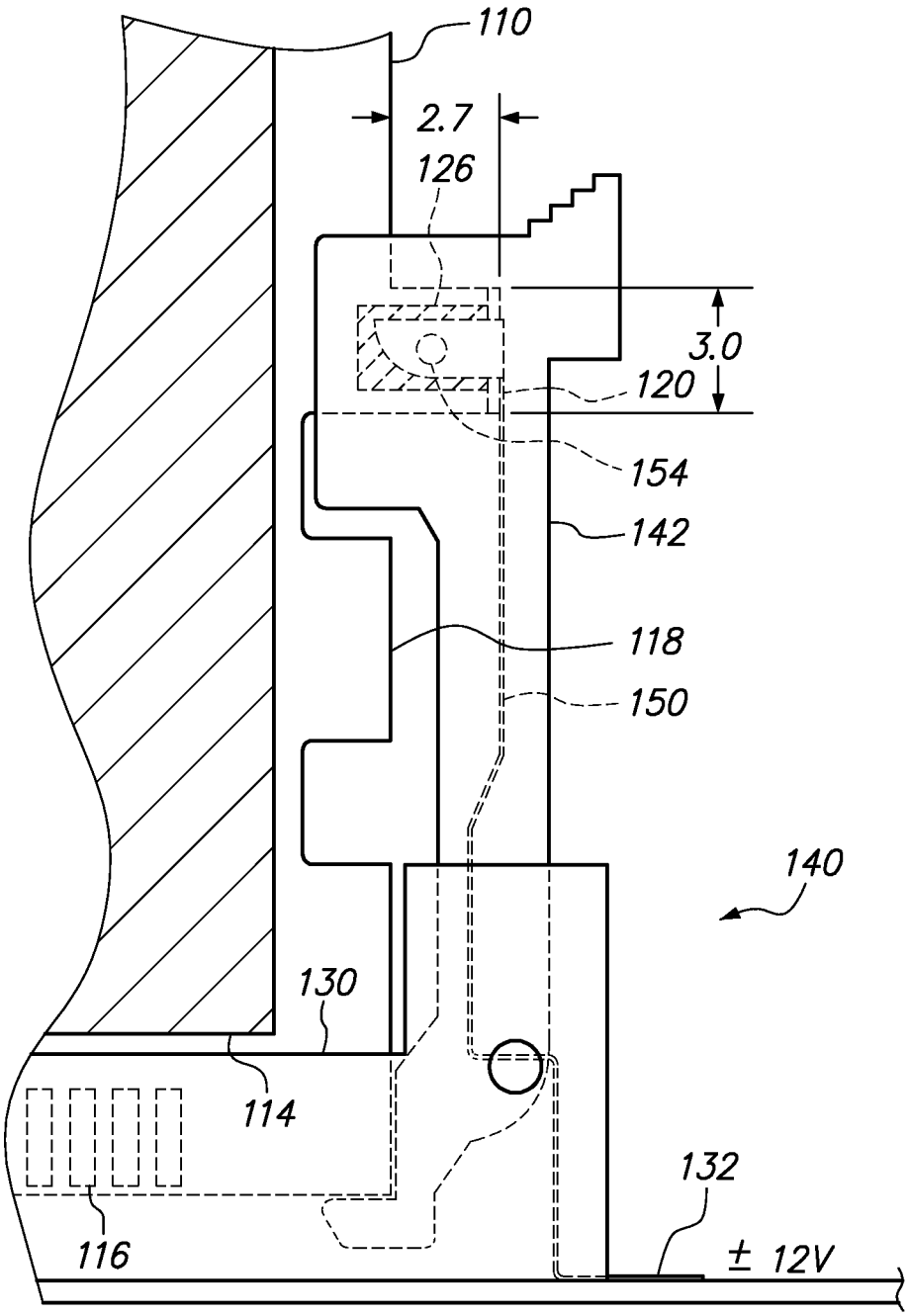
FIG. 6 is an enlarged view of the right side of the memory module of FIG. 5 positioned in a socket configured to interchangeably receive the memory module or a standard DIMM.

FIG. 6 is an enlarged view of the one side (the "righthand side") of the memory module 110 of FIG. 5 in a fully seated position of a socket 130 configured to interchangeably receive the memory module 110 or a standard DIMM. The socket 130 uses surface mount technology (SMT) as indicated at 132 as an alternative to the press-fit concept of the embodiment in FIGS. 2-4. Some features of the socket 130 and latch 140 are omitted for clarity. The tab dimensions in this configuration are approximately 2.7 mm wide by 3.0 mm tall, positioning the auxiliary voltage pads 126 beyond the rest of the vertical card edge 118. An internally routed, electrically conductive beam 150 includes latch contacts 154 at locations corresponding to the auxiliary voltage pads 126. In this embodiment, only one pair of latch contacts 154 are provided at positions corresponding to positions of a pair of the auxiliary voltage pads 126 on opposing faces of the tab 120.

This configuration facilitates enabling the socket to be interchangeably used with either a standard DIMM of standard length "L" or the persistent SSD type memory module 110. Because the lower card edge has the same length L as a standard DIMM length, the socket can interchangeably receive either the standard DIMM or the memory module 110. The socket contacts and lower card edge contacts may be provided at the same, standard positions. When the memory module 110 is fully seated in the socket 130 and the lever 142 is closed, the latch contacts 154 engage the auxiliary voltage pads 126, completing an electrical circuit through the beam 150 from a 12V source to the memory module 110. However, if a standard DIMM is positioned in the socket, the latch contacts 154 would not come into contact with the DIMM or any electrical features thereof, due to the outward spacing of the latch contacts 154 relative to the standard DIMM length L. A CPU and memory controller (See, e.g. FIG. 4) could be configured to intelligently sense whether a standard DIMM or the persistent SSD type memory card 110 is being used. Note that a standard DIMM or the persistent SSD type memory card 110 would receive the lower voltage (e.g. 1.5V) so that a standard DIMM could be powered from voltage supplied by the socket 130 to the card edge 116.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, components and/or groups, but do not preclude the presence or addition of one or more other features, integers, steps, operations, elements, components, and/or groups thereof. The terms "preferably," "preferred," "prefer," "optionally," "may," and similar terms are used to indicate that an item, condition or step being referred to is an optional (not required) feature of the invention.

The corresponding structures, materials, acts, and equivalents of all means or steps plus function elements in the claims below are intended to include any structure, material, or act for performing the function in combination with other claimed elements as specifically claimed. The description of the present invention has been presented for purposes of illustration and description, but it not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. An apparatus comprising:

a memory module including a semiconductor card having horizontal upper and lower card edges, a pair of vertical card edges, and a pair of opposing card faces, with card edge voltage pads along the lower card edge, auxiliary voltage pads along at least one of the vertical card edges, and one or more memory chips on one or both card faces;

a socket for receiving the memory module at the lower card edge and supporting the memory module in a fully seated position, the socket including a plurality of electrical socket contacts for engagement with the card edge voltage pads along the lower card edge when the memory module is in the fully seated position; and a latch pivotally coupled to the socket and movable between a latched position and an unlatched position, the latch including electrical latch contacts positioned for being engaged with the auxiliary voltage pads when in the latched position and being disengaged from the auxiliary voltage pads when in the unlatched position.

2. The apparatus of claim 1, wherein the one or more memory chips comprise one or more persistent solid-state memory devices.

3. The apparatus of claim 2, further comprising:

an auxiliary voltage source in electrical communication with the latch contacts for supplying a voltage to the auxiliary voltage pads of the persistent, solid-state memory devices.

4. The apparatus of claim 3, wherein the auxiliary voltage source supplies at least about 12V to the auxiliary voltage pads.

5. The apparatus of claim 3, wherein the electrical socket contacts engage the card edge voltage pads and supply a voltage that is different than the voltage supplied to the auxiliary voltage pads on the vertical card edges.

6. The apparatus of claim 1, further comprising:

an electrically conductive beam extending through the latch and having a lower end for connecting to a voltage line of a printed circuit board and an upper end defining the latch contacts, wherein the beam is configured for flexing with movement of the latch between the open and closed positions.

7. The apparatus of claim 1, further comprising:

a notch on each of the vertical card edges, wherein the one or more auxiliary voltage pads comprise an auxiliary voltage pad on each card face adjacent to the notch.

8. The apparatus of claim 7, wherein the auxiliary voltage pad on each card face adjacent to the notch is vertically aligned with the notch.

9. The apparatus of claim 1, wherein the socket is configured to interchangeably receive the memory module or a standard-length dual in-line memory module (DIMM).

10. The apparatus of claim 9, wherein the auxiliary voltage pads on opposite vertical edges of the memory module and the latch contacts on opposite side latches are spaced greater than the standard length of the DIMM.

11. A memory system comprising:

a persistent, solid-state memory module including a card having horizontal upper and lower card edges, a pair of vertical card edges, and a pair of opposing card faces, with card edge voltage pads along the lower card edge, auxiliary voltage pads along at least one of the vertical card edges, and a persistent, solid-state memory structure on one or both card faces;

a socket for receiving the persistent, solid-state memory module at the lower card edge and supporting the persistent, solid-state memory module in a fully seated position, the socket including a plurality of electrical socket contacts for engagement with the card edge voltage pads along the lower card edge when the memory module is in the fully seated position;

a latch pivotally coupled to the socket and movable between a latched position and an unlatched position, the latch including electrical latch contacts positioned for being engaged with the auxiliary voltage pads when the latch is in the latched position and being disengaged from the auxiliary voltage pads when the latch is in the unlatched position; and an auxiliary voltage source in electrical communication with the latch contacts for supplying a voltage to the auxiliary voltage pads of the persistent, solid-state memory module.

12. The memory system of claim 1, wherein the persistent, solid-state memory module has the length of a standard dual in-line memory module (DIMM) and the socket is sized to interchangeably receive a standard DIMM or the persistent, solid-state memory module.

13. The memory system of claim 12, further comprising:

a processor and a memory controller in electronic communication with the socket, the processor and memory controller configured for sensing the presence or absence of the auxiliary voltage pad to determine whether the persistent, solid-state memory module or a standard DIMM is inserted into the socket.

14. The memory system of claim 11, wherein the auxiliary voltage source supplies at least about 12V to the auxiliary voltage pads.

15. The memory system of claim 13, wherein the socket contacts engage the card edge voltage pads and supply a voltage that is different than the voltage supplied to the auxiliary voltage pads on the vertical card edges.

16. The memory system of claim 11, further comprising:

an electrically conductive beam extending through the latch and having a lower end for connecting to a voltage line of a printed circuit board and an upper end defining the latch contacts, the beam configured for flexing with movement of the latch between the open and closed positions.

17. The memory system of claim 11, further comprising:

a notch on each of the vertical card edges, wherein the one or more auxiliary voltage pads comprise an auxiliary voltage pad on each card face adjacent to the notch.

18. The memory system of claim 17, wherein the auxiliary voltage pad on each card face adjacent to the notch is vertically aligned with the notch.

19. The memory system of claim 11, wherein the auxiliary voltage pads on opposite vertical edges of the memory module and the latch contacts on opposite side latches are spaced greater than the standard length of the DIMM.

20. The memory system of claim 1, wherein the memory module comprises an NV-DIMM.

* * * * *